US005551150A

United States Patent [19]

Zielinski et al.

[11] Patent Number: 5,551,150

[45] Date of Patent: Sep. 3, 1996

[54] METHOD OF FABRICATING AN ELECTRICAL TERMINAL

[75] Inventors: Thomas E. Zielinski, China; Gregg A. Eisenmann, Canton; Robert D. Kennedy, Northville; Nickolas O'Branovic, Royal Oak; Sucha S. Sian, Southfield, all of Mich.

[73] Assignee: Chrysler Corporation, Auburn Hills, Mich.

[21] Appl. No.: 466,530

[22] Filed: Jun. 6, 1995

Related U.S. Application Data

[62] Division of Ser. No. 155,506, Nov. 22, 1993, Pat. No. 5,427,562.

[51] Int. Cl.[6] ..... H01R 43/04

[52] U.S. Cl. ..... 29/882; 29/884; 439/852; 439/887

[58] Field of Search ..... 439/851, 887, 439/852; 29/874, 882, 884

[56] References Cited

U.S. PATENT DOCUMENTS

| | | | |
|---|---|---|---|
| 3,370,265 | 2/1968 | Berg . | |
| 4,203,203 | 5/1980 | Gilissen et al. | 29/846 |
| 4,415,221 | 11/1983 | Inoue et al. . | |
| 4,453,799 | 6/1984 | Inoue . | |
| 4,472,017 | 9/1984 | Sian . | |
| 4,487,051 | 12/1984 | Iwamoto | 72/312 |
| 4,488,355 | 12/1984 | Hutchins et al. | 29/882 |
| 4,520,646 | 6/1985 | Pauzin | 72/313 |
| 4,553,420 | 11/1985 | Fierkens et al. | 72/380 |
| 4,560,231 | 12/1985 | Shirai | 439/851 X |
| 4,564,259 | 1/1986 | Vandame . | |
| 4,699,444 | 10/1987 | Isohata | 439/852 X |
| 4,834,681 | 5/1989 | Chaillot | 439/852 X |
| 4,838,816 | 6/1989 | Matsusaka et al. | 439/852 X |
| 4,909,762 | 3/1990 | Yagi et al. | 439/852 |
| 4,927,788 | 5/1990 | Nakashima et al. | 439/887 |
| 4,950,183 | 8/1990 | Watanabe et al. | 439/852 X |
| 5,235,743 | 8/1993 | Endo et al. | 29/874 X |
| 5,269,712 | 12/1993 | Denlinger et al. | 439/845 |

FOREIGN PATENT DOCUMENTS

| | | | |
|---|---|---|---|
| 0313253A2 | 11/1988 | European Pat. Off. | 13/11 |
| 1427747 | 1/1966 | France . | |
| 5-251156 | 9/1993 | Japan | 29/874 |

*Primary Examiner*—Carl J. Arbes
*Attorney, Agent, or Firm*—Christopher A. Taravella

[57] ABSTRACT

A female electrical connector element for connecting a wire lead to a male contact pin has a first end which is crimped to the wire lead and a second end in the form of a socket. The socket includes a cantilevered contact floor and a separate spring contact in opposed relation to the cantilevered contact floor. The male contact pin is inserted between the spring biased contact surface and the cantilevered contact floor to establish an electrical connection. In accordance with the method of fabricating the connector, the cantilevered contact floor is supported sequentially by a series of forming surfaces at a bight portion thereof while the contact floor is being bent through 180°. The side flanges of the female component are then folded over the contact for making an enclosure for defining the socket that retains the unitary spring contact.

8 Claims, 7 Drawing Sheets

METHOD OF FABRICATING AN ELECTRICAL TERMINAL

This is a division of the application Ser. No. 08/155,506 filed Nov. 22, 1993 U.S. Pat. No. 5,427,562.

FIELD OF THE INVENTION

The present invention relates to an electrical terminal and to a method for fabricating that terminal. More particularly, the present invention relates to an electrical terminal and a method of fabricating that terminal wherein the terminal is a female terminal utilizing a contact spring to urge an inserted male contact blade into contact with a contact floor which is unitary with the female terminal.

BACKGROUND OF THE INVENTION

As automobiles increasingly rely on electrical components, the number of electrical terminals necessarily increases. In that the electrical components interact with one another, it is increasingly important that electrical connections be properly made so that each contact carries the current load which it is expected to transmit. In automobiles, electrical connections are frequently subjected to impacts and vibration due to the motion and vibration caused by both vehicular motion and engine operation. In addition, since many electrical components are proximate the engine of a vehicle, the components are subjected to heat. Moreover, moisture and road dirt can over time invade electrical terminals when from time to time the terminals are disconnected for maintenance purposes.

Preferably, electrical terminals should maintain good contact when connected, while allowing the terminals to be easily both initially connected, and subsequently disconnected and then reconnected, perhaps a number of times. Over time, many currently available electrical may terminals fail to continuously transmit adequate current and, from time to time, may fail when being disconnected and reconnected.

It is also highly desirable to maximize the current carrying capacity of electrical terminals so that their physical size may be minimized as well as their number.

SUMMARY OF THE INVENTION

In view of the aforementioned considerations, it is a feature of the instant invention to provide a new and improved electrical terminal in which a good, reliable electrical connection is maintained over a time with periodic disconnections and reconnections, which does not fail during either the fabrication process or upon initial coupling and which has increased current carrying capacity.

In view of this feature and other features, the present invention is directed to a female electrical terminal element having means at one end for crimping a wire lead thereto and a second end in the form of a socket for receiving a male contact pin. The socket includes a cantilevered contact floor which is unitary with the socket and is formed by folding the cantilevered contact floor about a bight while maintaining support at the bight. A separate spring biased contact is disposed within the socket in opposed relation to the cantilevered contact floor for urging the male contact blade into abutment with the cantilevered contact floor.

The instant invention is also directed to a method for forming a female electrical terminal component which is affixed at one end to a wire lead and which has a female socket at the other end for receiving a male contact blade urged into abutment with a portion of the socket by a contact spring. In accordance with the method, the female component is formed from a unitary blank by folding a pair of side flanges to extend substantially normal with respect to a base portion to form a channel. A cantilevered contact floor is then folded about a bight, while in alignment with the channel, to overlie the base portion. While the cantilevered contact floor is being folded, it is supported at the bight. The side flanges are then bent so that free ends thereof overlie the contact portion in spaced relation with respect thereto to form the socket.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
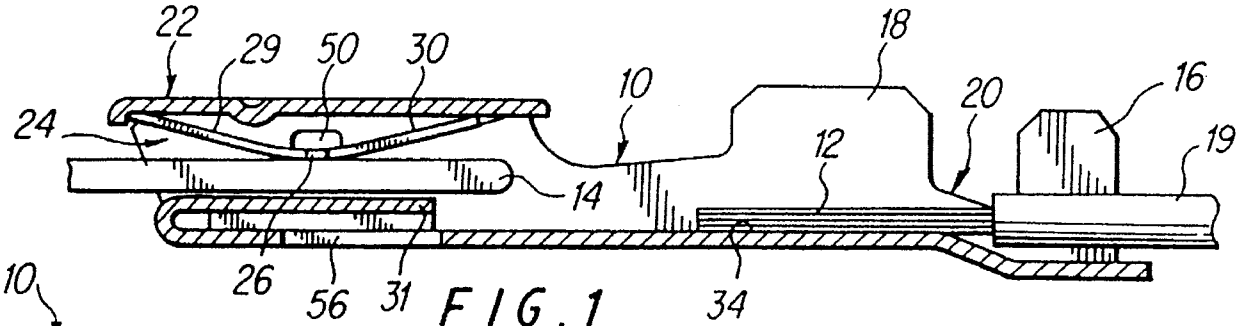
FIG. 1 is a side elevation illustrating a female electrical terminal in accordance with the instant invention crimped at one end to a wire lead and detachably connected at the other end with a contact blade of a male terminal.
Figure 2:
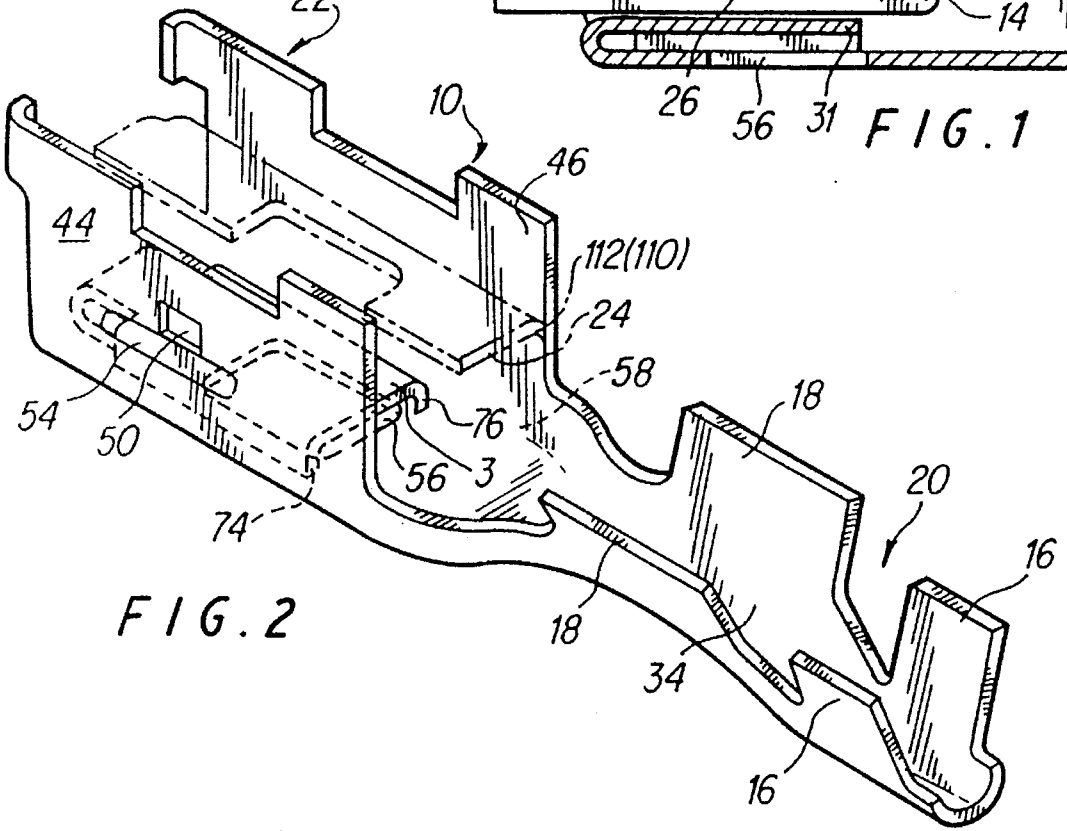
FIG. 2 is a perspective view of the female electrical terminal with portions partially bent and with portions in phantom.

Referring now to FIGS. 1 and 2, there is shown a female electrical terminal 10 for connecting an electrical wire lead 12 to a male contact blade 14. The female electrical terminal 10 retains the wire lead 12 by first and second pairs of crimp flanges 16 and 18 which are crimped over the wire lead 12 and its insulation 19, respectively, at a first end 20 of the female terminal. At a second end 22 of the female terminal 10, there is disposed a socket 24 having a spring biased contact surface 26 therein. The spring biased contact surface 26 is unitary with, and biased by, a bowed or leaf spring contact 28 having two arms 29 and 30 which urge the contact surface 26 into abutment with the male contact blade 14. Beneath the male contact blade 14 is a cantilevered contact floor 31. The leaf spring contact 28 is in part longitudinally retained by an abutment 32 extending from the top wall of the abutment 32 extending from the top wall of the socket 24, a short distance into the socket and engages and end edge 33 of the leaf spring contact when the leaf spring contact is stressed.

In an electrical terminal of the type illustrated in FIGS. 1 and 2, 80%–90% of the current flows through the cantilevered contact floor 31 into the body of the female electrical terminal 10 so as to be transmitted through to the wire lead 12 via the crimp 18 and a rear bottom surface 34 of the first end 20 of the terminal 10. It is therefore very important that the electrical terminal contact surface between the male contact blade 14 and the cantilevered contact floor 31 be adequately maintained and not deteriorate over time due to various mechanical and environmental factors. Moreover, it is important that cantilevered contact floor 31 transmit as much current as possible. Therefore, it is desirable that the current carrying capacity of the cantilevered contact floor 31 not be diminished during fabrication.

Figure 3:
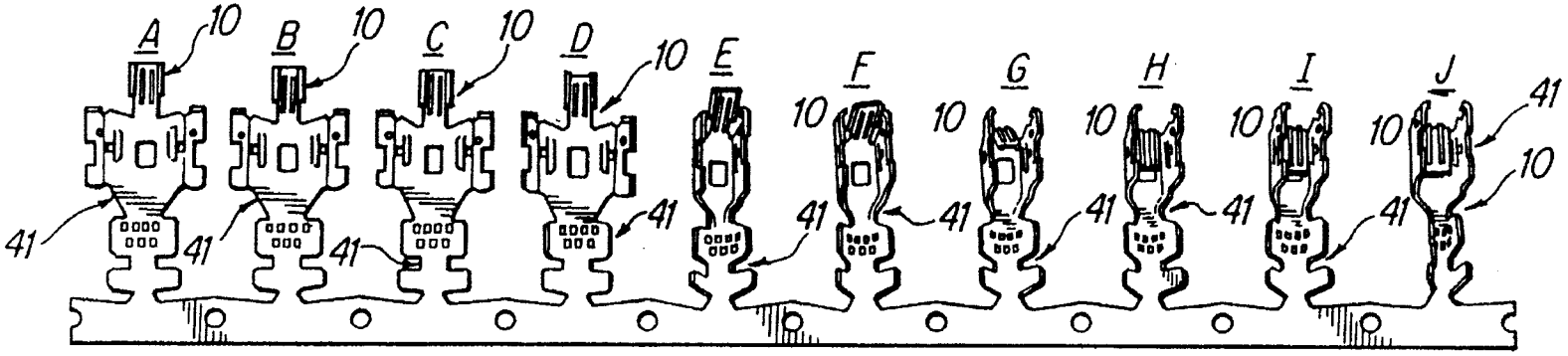
FIG. 3 is a top view of a strip with a plurality of female terminal blanks extending therefrom in various stages of fabrication.

Referring now to FIG. 3, there is shown a strip 40 having a plurality of the female electrical terminals 10 mounted thereon for folding by the fabrication machinery of FIGS. 8–13. As the strip 40 is advanced, various unitary sections of the female electrical terminal 10 are folded over one another so that the female terminal is ready to receive the wire lead 12 (FIG. 1), the spring biased contact 26 (FIG. 1) and ultimately the male contact pin 14 (FIG. 1).

Figure 4:
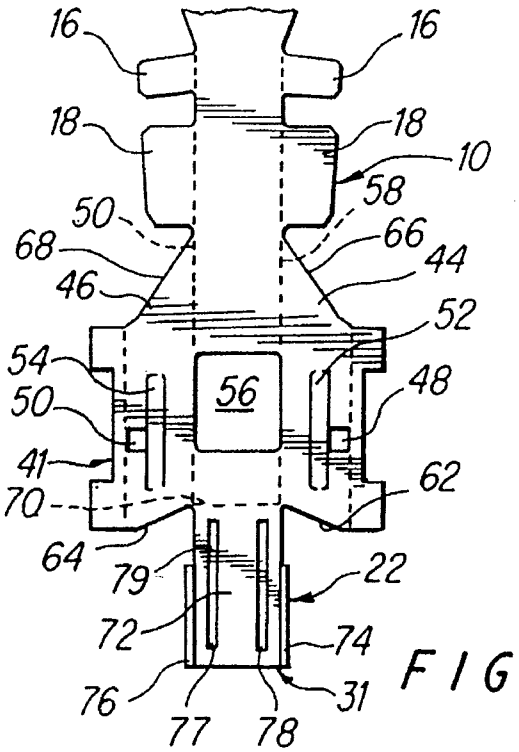
FIG. 4 is an enlarged top view showing a cut blank from which the female electrical terminal is formed by bending.

Referring now to FIG. 4 wherein the female electrical terminal 10 is shown enlarged as a blank 41 before folding, it is seen that the second end 22 which is folded to form the socket 24 for receiving the male contact pin blade 14 includes first and second side flanges 44 and 46. The first and second side flanges 44 and 46 each include, respectively, windows 48 and 50 as well as embossments 52 and 54 which form raised shelves. Inboard of the embossments 52 and 54, a large window 56 is disposed in a front base portion 57 of the terminal 10. Between the large window 56 and shelves 52 and 54 are fold areas 58 and 60 which, as is seen in FIGS. 5 and 6, allow the side flanges 44 and 46 to be bent up out of the plane of the terminal blank shown in FIG. 4.

In order to facilitate bending, the flanges 44 and 46 have leading edges 62 and 64 and trailing edges 66 and 68. The leading edges 62 and 64 also intersect with a fold line 70 which extends perpendicular to the fold lines 58 and 60 so as to allow the cantilevered contact floor 31 to fold approximately 180° over the front base portion 57 of the female terminal 10 in overlying relation to the large window 56 (see FIG. 1). The cantilevered contact floor 31 has a bottom surface 72 having a pair of longitudinally extending feet or foot flanges 74 and 76 extending substantially perpendicularly therefrom (see FIGS. 2 and 15). The cantilevered contact floor 31 also has a pair of contacting ribs 77 and 78 which are formed therein by embossing the contact floor before it is folded. The contact ribs 77 and 78 extend longitudinally on the contact floor 31 and have flattened shallow portions 79 proximate fold line 70. When the female terminal 10 is assembled, the contacting ribs 77 and 78 contact the male contact pin 14 (see FIG. 1).

Figure 6:
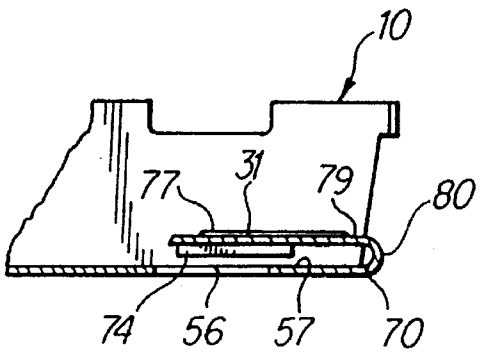
FIG. 6 is a view similar to FIG. 5 showing the contact floor bent to a final position.
Figure 5:
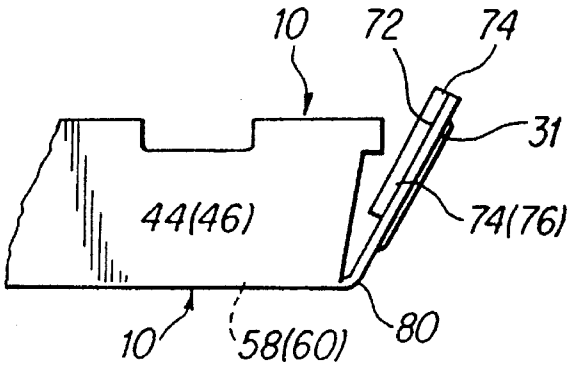
FIG. 5 is an enlarged side view showing side flanges bent upward and a cantilevered contact floor being bent upward.

In FIG. 5, the cantilevered contact floor 31 and the side flanges 44 and 46 are bent upwardly from the front base portion 57 and in FIG. 6, the cantilevered contact floor is bent to overlie the contact front base portion. If the cantilevered contact floor 31 is bent from the position of FIG. 4, through the position of FIG. 5 to that of FIG. 6, then the bight 80 of the resulting U-shaped configuration is subject to "orange peeling" due to stress cracks rather randomly formed as the cantilevered contact floor 31 is bent. These random cracks substantially reduce the amount of current that the terminal can carry. By employing features of the present invention, as is set forth in FIGS. 8–13, orange peeling is substantially avoided and the current carrying capacity of the entire terminal 10 is enhanced.

Figure 7:
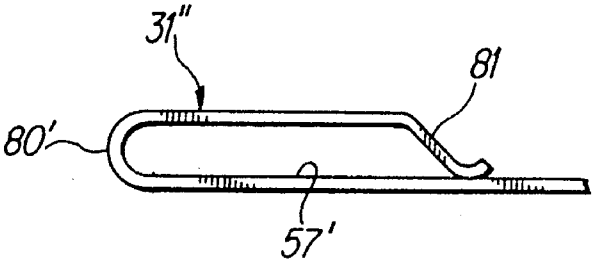
FIG. 7 PRIOR ART
FIG. 7 is a view of a prior art contact floor.

In order to facilitate the steps shown in FIGS. 8–13, the terminal of the present invention is configured differently from the terminal of the prior art shown in FIG. 7, wherein a tab 81 projects downwardly from the cantilevered contact floor 31' and engages the front base portion 57'. The tab 81 prevents the bight portion 80' of the prior art cantilevered contact floor 31' from being supported internally as it is bent and therefore results in a terminal with stress cracks at the bight which lower the current carrying capacity of prior art terminals. The cantilevered contact floor 31 of the present invention has a free end instead of an end with a tab. In the present invention, the feet 74 and 76 extend from the sides of the contact floor 31 toward the front base portion 57.

Figure 8:
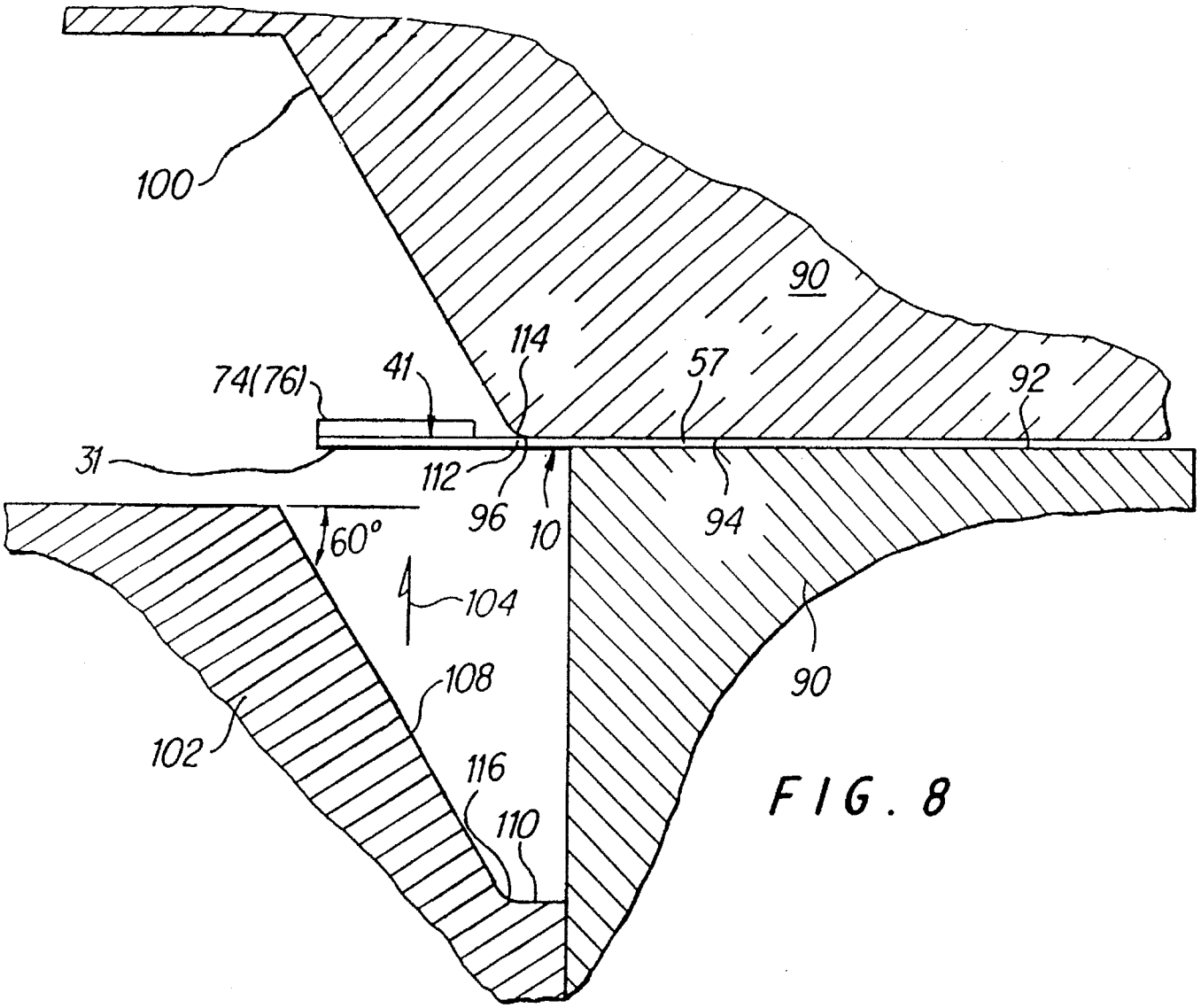
FIG. 8 is a side elevation showing die faces holding the blank and advancing to fold the cantilevered contact floor to a first position in a first bending step.

Referring now to FIG. 8 where the blank 41 of the terminal 10 (also see FIGS. 3 and 4) is shown being bent in accordance with the principles of the instant invention, it is seen that the blank 41 is supported on a die shoe 90 having a flat surface 92 for supporting the blank 41. A die punch 92 with a flat surface 94 retains the blank 41 against the die shoe 90. The die punch 92 has an overhanging projecting portion 96 which projects beyond a die surface 98 on the die shoe 90. The die punch also includes a forming surface 100 which projects at a 60° angle with respect to the blank 41 or a 120° angle with respect to the surface 94. In order to being folding the cantilevered contact floor 31, a first die 102 is advanced in the direction of an arrow 104 to engage and bend the cantilevered contact floor with an angled surface 108. The angled surface 108 also extends at 60° with respect to the extent of the blank 41 and includes a section 110 joined to the surface 105 by a corner 111. The die punch 92 has a width which is less than the space between the feet 74 and 76 of the cantilevered contact floor. As the first die 102 bends the contact floor at a location 112 juxtaposed with the corner 114 on the die punch 92 and the corner 116 on the first die face 102, the feet 74 and 76 straddle the surface 100. The first bend is about 60° so that the cantilevered contact floor 31 is at an angle of about 120° with respect to the front base portion 57 of the blank 41.

Figure 9:
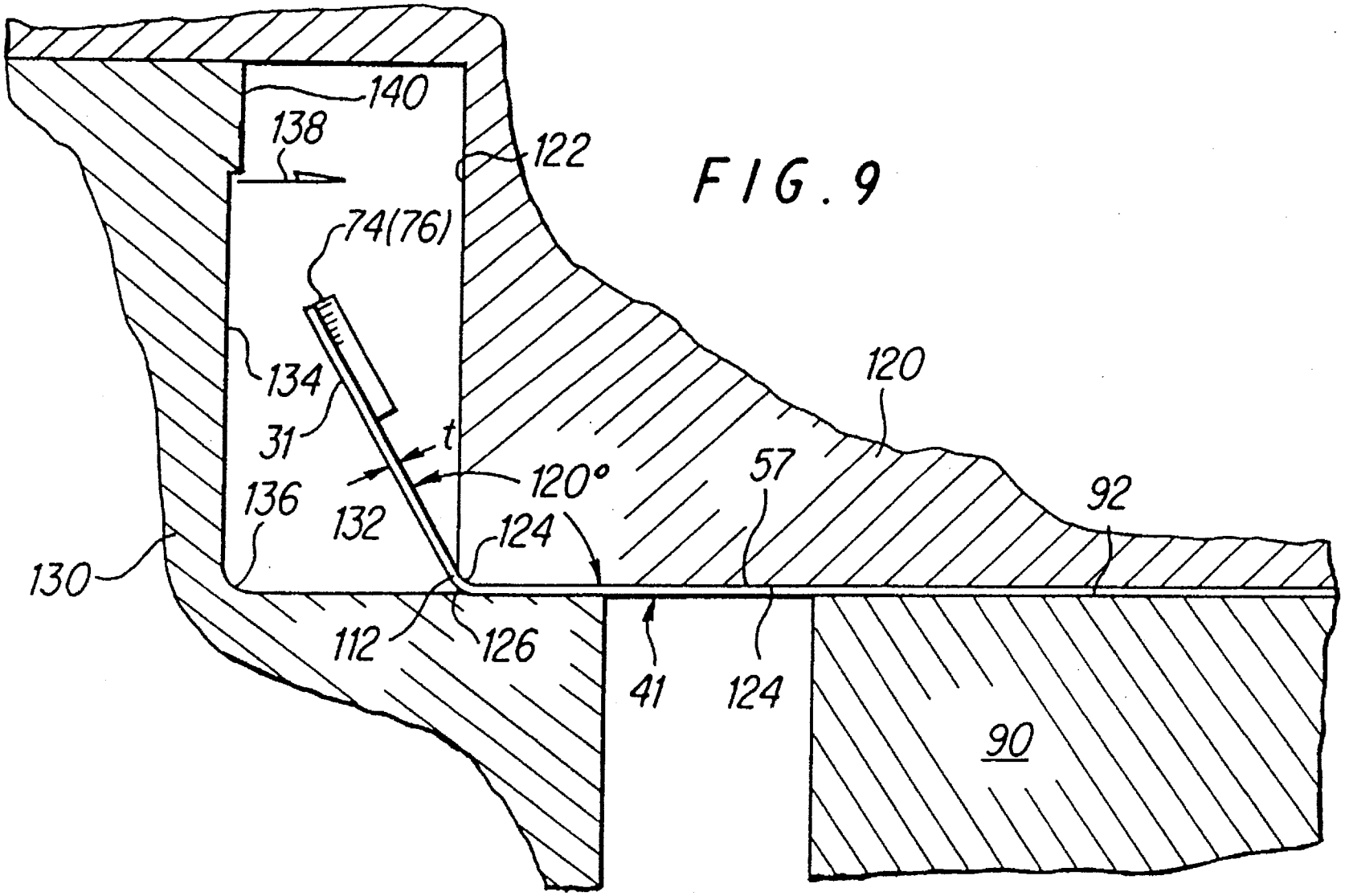
FIG. 9 is a view similar to FIG. 8 and showing second die faces folding the cantilevered contact floor to a second position in a second bending step.

Referring now to FIG. 9, where the blank 41 is shown after the 120° bend in the cantilevered contact floor 31 is introduced by the step of FIG. 8, the blank 41 is supported by the die shoe 90 and also by a second die punch 120 which now clamps the blank 41 further outboard of the die shoe. The die punch 120 has a die punch surface 122 which is perpendicular to a bottom surface 124 opposed to the upper surface 92 of the die shoe 90 and includes a curved corner 124 around which the bend 126 in the blank 41 is formed. Opposing the die punch 120 is a second die 130 having a die face 132 parallel to the surface 124 of the die punch and a die face 134 perpendicular to the die face 132. The two die faces are joined by a curved die corner 136 which complements the curved die corner 124 on the die punch 120 as the second die 130 moves in the direction of the arrow 138 to bend the cantilevered contact floor 31 substantially normal to the floor portion 57 of blank 41. A land 140 projects from the die face 134 to provide space for accommodating the thickness t on the cantilevered contact floor 31. Again, the die punch 120 has a width which fits between the feet 74 and 76 on the cantilevered contact floor 31. The second bend is about 30° so that the cantilevered contact floor 31 is at about 90° to the front base portion 57 of the blank 41.

Figure 10:
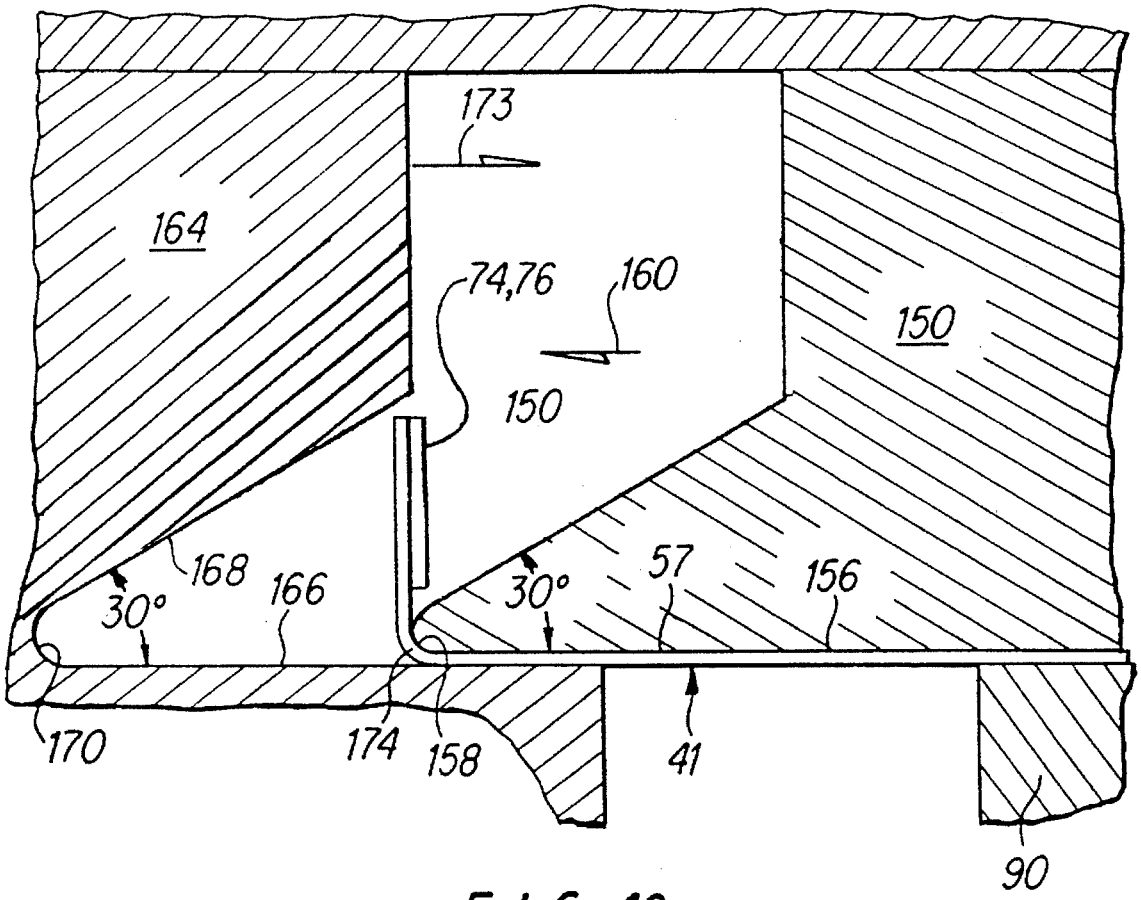
FIG. 10 is a view similar to FIGS. 8 and 9 showing third die faces bending the cantilevered contact floor to a third position in a third bending step.

Referring now to FIG. 10, the blank 41 is shown with the cantilevered contact floor 31 extending perpendicular to the front base portion 57 of the blank 41 after being bent in accordance with the step of FIG. 9. In FIG. 10, the blank 41 is still supported by the die shoe 90; however, a mandrel 150, having a triangular projection 152 with a 30° face 154 and a bottom face 156, is used to bend the cantilevered contact floor 31 about a curved nose 158. The mandrel 150 travels in the direction 160. A third die 164 has a first horizontal die face 166 and an angled die face 168 disposed at 60° with respect to the face 166, the die faces 166 and 168 being joined by an arcuate bight 170. The third die 164 advances in the direction of arrow 172 toward the mandrel 150, while the mandrel advances toward the die 164 in the direction of arrow 173. The curved faces 158 and 170 bend the blank 41 at area 174 which forms the bight 80 so as to assume the 30° bend of FIG. 11. The third bend is therefore about 60°.

Figure 11:
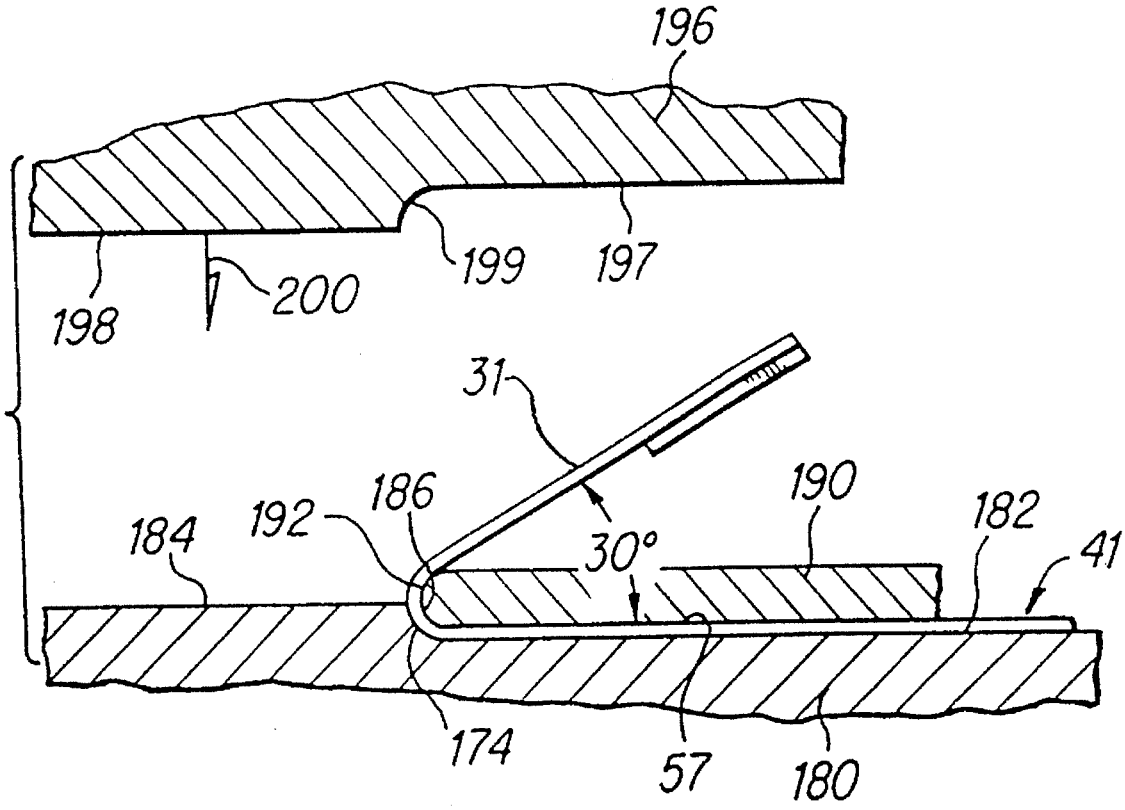
FIGS. 11 and 12 are views similar to FIGS. 8–10 showing the cantilevered contact floor being bent to a fourth position in a fourth bending step.

Referring now to FIG. 11, a die shoe 180 now has a configuration wherein a first flat supporting surface 182 supports the blank 41 and is joined by a second surface 184 which is substantially parallel to the first surface 182. The second flat surface 184 joins the first surface with a concave surface 186. The bight portion 80 of the blank 41 is urged against the concave curved portion 186 by a second mandrel 190 which has a curved nose portion 192 that complements the curvature of both the curved die portion 186 and the bight 80 of the blank 41. A die punch 190 has a first flat 192 in opposition to the flat 182 on the die shoe 180 and a second flat 194 in opposition to the second flat 184 in the die shoe. The flats 192 and 194 are joined by concave curve 196. In operation, the die punch 196 advances in the direction of arrow 200 toward the die shoe to bend the cantilevered contact floor about 30° so that it extends substantially parallel with the front base portion 57.

Figure 12:
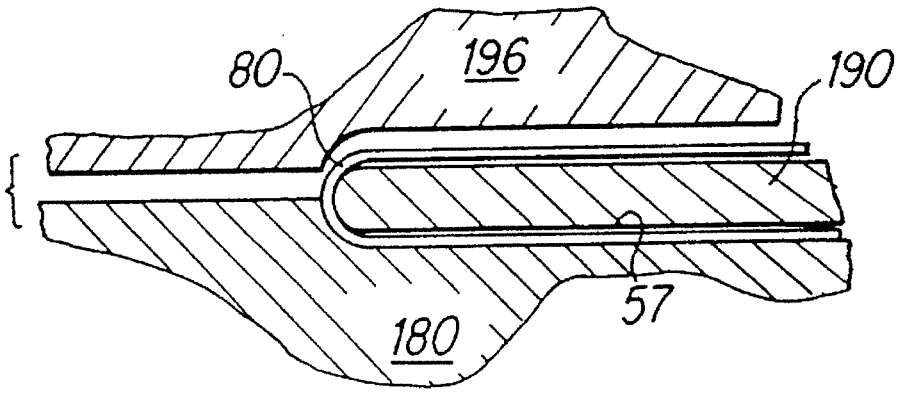

As is seen in FIG. 12, the die punch 190 bends the cantilevered contact floor 31 over so that it extends substantially parallel to the front base portion 57 of the blank 41. As this final bend is performed, the cantilevered contact floor 31 is supported by the curved nose 192 of the mandrel 190.

Figure 13:
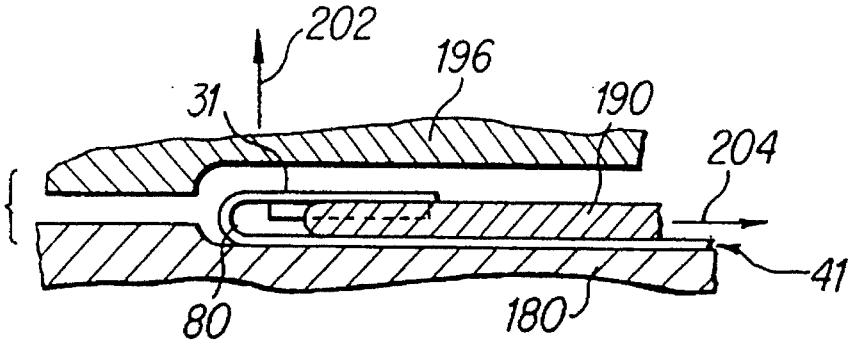
FIG. 13 is a view similar to FIGS. 11 and 12 showing the dies releasing the finally formed cantilevered contact floor.

As is seen in FIG. 13, the die punch 196 is then raised in the direction of arrow 202, while the mandrel 190 is withdrawn in the direction of arrow 204. In that the bight 80 joining the cantilevered contact floor 31 to front base portion 57 has been substantially supported during the entire formation of the bend disposing the cantilevered contact floor substantially parallel to front base portion 57 of the blank 41, the resulting bight results in a female terminal 10 which has enhanced reliability.

As was previously stated, this is readily apparent because the orange peeling which occurs at the bight 80 when the cantilevered contact floor 31 is not formed with support at the bight, no longer occurs. It is of utmost importance that the contacting ribs 77 and 78 of the cantilevered contact floor 31 remain, many times for years, in abutment with a male contact pin 14 under the urging of the contact spring 26 (see FIG. 1).

As is perhaps best seen in FIG. 1, the spring arms 29 and 30 have relatively small contact areas with the surfaces of the folded flanges 44 and 46 compared to the relatively large contact area provided by the contacting ribs 78 and 79 of the cantilevered contact floor 31. If the bight portion 80 of the cantilevered contact floor 31 fractures or develops cracks due to the bending of the contact floor during fabrication, then its efficiency for transmitting current is reduced. If the actual connecting area is substantially reduced, then the current flowing around the bight portion 80 may be channeled through metal of small cross-sectional area. This can result in these cross-sectional areas heating and, after a time, rupturing.

It has been found that up to 90% of the current flows through the cantilevered contact floor 31 and that, in a terminal made of copper alloy having a length of about ¾ inch or 2 cm, a width of about ⅛ inch (0.5 cm) and a height of about 3/32 inch (0.2 cm), up to 50 amps of current is successfully conducted under ambient conditions and 40 amps of current successfully conducted without failure under shock conditions. This results in a terminal 10 which is under-rated at 25 amps. The prior art terminals have a shock rating of about 25 amps and are underrated at 5–20 amps. When such terminals conduct only 20 amps, then there may be an increased risk of failure if the shock rating is only 25 amps. Accordingly, either many more terminals, or terminals of a larger size, are required in automotive installations when using the prior art terminals. Making terminals larger or using more terminals results in inherent design disadvantages over using smaller or fewer numbers of terminals.

Figure 14:
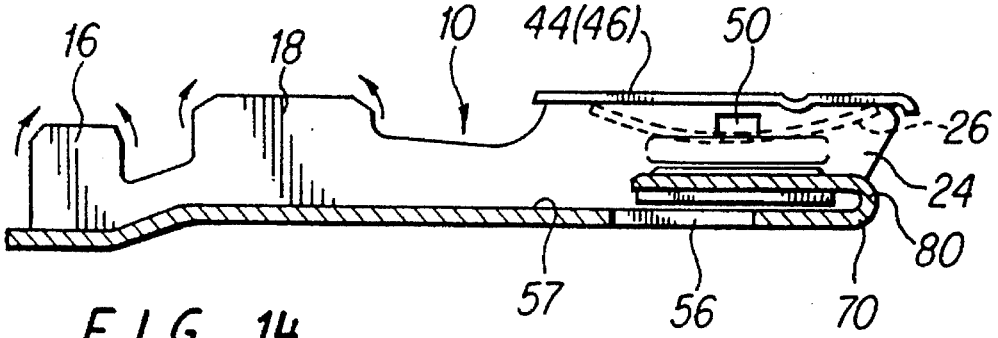
FIG. 14 is a side elevation of the female terminal after side flanges have been folded over to form a socket.

Referring now to FIG. 14, after the floor portion 31 has been bent to the position of FIGS. 13 and 14, the contact spring 26 is mounted between the upstanding side flanges 44 and 46. After the contact spring 26 is inserted, flanges 44 and 46 are bent over, as is seen in FIGS. 1, 2 and 14, to form the socket 24. The flanges 16 and 18 are then bent over for crimping to the wire lead 12 (see FIG. 1).

Figure 15:
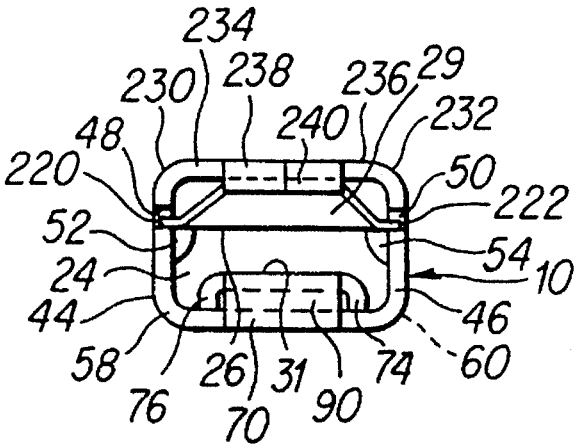
FIG. 15 is a front view of the assembled female terminal.

As is seen in FIG. 15, the spring arms 29 and 30 of the contact spring 26 have tabs 220 and 222 which laterally extend through the small windows 40 and 50, respectively, to retain the spring arms. The spring arms are additionally supported on the shelves 52 and 54. The side flanges 44 and 46 which form side walls are then again folded at fold lines 230 and 232 so that upper portions 234 and 236 of the side flanges which form top walls overlie the unitary, spring contact surface 26 and retain the contact surface and its associated spring arms 29 and 30 within the socket 24. The spring through holes 40 and 50 keeps it from being pulled out as a blade is removed. The end flanges protect the spring from being overstressed. A pair of end flanges 238 and 240 on the top portions 234 and 236 of the side flanges 44 and 46 form an abutment which engage the spring arm 28 so that the unitary, spring contact surface 26 does not slide out of the socket 24 when the male contact pin 14 is withdrawn therefrom.

Figure 16:
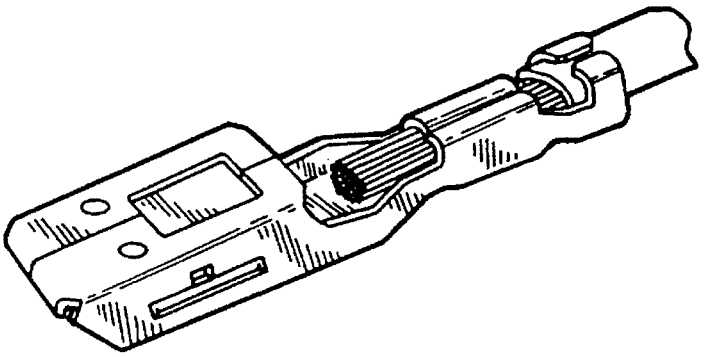
FIG. 16 is an enlarged, perspective view of the assembled female terminal receiving the contact pin of a male terminal.

Referring now to FIG. 16, there is shown an enlarged view of the fabricated and assembled female terminal 10 receiving the male contact pin 14 to connect the male contact pin to the wire lead 12. An example of the entire female terminal 10 has a length of about ¾ inch (2 cm), a width of about ⅛ inch (0.5 cm) and a height of about 3/32 inch (0.2 cm).

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a method for forming a female electrical terminal socket which is adapted to be affixed at one end to a wire lead and which has a socket at the other end for receiving a male contact pin urged into abutment with a portion of the socket by a contact spring, the improvement comprising the steps of forming the female socket from a unitary blank by:

a) folding a pair of side flanges to extend substantially normal with respect to a base portion to form a channel;

b) bending a cantilevered contact floor about a bight thereof into alignment with the channel so as to overlie the base portion;

c) while bending the cantilevered contact floor, supporting the cantilevered contact floor continuously at the bight thereof to minimize the formation of cracks; and d) bending the side flanges so that free ends thereof overlie the cantilevered contact floor in spaced relation with respect thereto to form a space therebetween for receiving the contact spring.

2. The improvement of claim 1, wherein the female electrical terminal is made of steel.

3. The improvement of claim 1, wherein the cantilevered contact floor is bent in a series of discrete steps from a first orientation in which the cantilevered contact floor extends in the same direction as the front base portion to the position in which the cantilevered contact floor overlies the front base portion.

4. The improvement of claim 3, wherein the discrete steps comprise a first discrete step of about 60°; a second discrete step of about 30°; a third discrete step of about 60°; and a fourth discrete step of about 30°.

5. The improvement of claim 4, wherein the female electrical terminal is made of steel.

6. The improvement of claim 3, wherein supporting the cantilevered contact floor while the floor is bent is accomplished by sequentially placing a series of supporting surfaces having progressively smaller angles with respect to the base portion of the blank between the cantilevered contact portion and the base portion of the blank.

7. The improvement of claim 6, wherein the discrete steps comprise a first discrete step of about 60°; a second discrete step of about 30°; a third discrete step of about 60°; and a fourth discrete step of about 30°.

8. The improvement of claim 7, wherein the female electrical terminal is made of steel.

* * * * *